US011718447B2

(12) United States Patent
Kloeters et al.

(10) Patent No.: US 11,718,447 B2
(45) Date of Patent: Aug. 8, 2023

(54) PALLET WITH STACKING STOPS ON THE PALLET DECK

(71) Applicants: Craemer GMBH, Herzebrock-Clarholz (DE); PreTurn GMBH, Neckarsulm (DE)

(72) Inventors: Rene Kloeters, Bad Friedrichshall (DE); Ralf-Peter Finke, Münster (DE)

(73) Assignee: Craemer GMBH and PreTurn GMBH

( * ) Notice: Subject to any disclaimer, the term of this patent is extended or adjusted under 35 U.S.C. 154(b) by 49 days.

(21) Appl. No.: 17/471,352

(22) Filed: Sep. 10, 2021

(65) Prior Publication Data

US 2022/0002026 A1 Jan. 6, 2022

Related U.S. Application Data

(63) Continuation of application No. PCT/EP2019/056846, filed on Mar. 19, 2019.

(51) Int. Cl.
*B65D 19/00* (2006.01)

(52) U.S. Cl.
CPC ..... *B65D 19/0016* (2013.01); *B65D 2519/00034* (2013.01); *B65D 2519/00069* (2013.01); *B65D 2519/0084* (2013.01); *B65D 2519/0096* (2013.01); *B65D 2519/00268* (2013.01); *B65D 2519/00288* (2013.01); *B65D 2519/00318* (2013.01); *B65D 2519/00333* (2013.01); *B65D 2519/00815* (2013.01)

(58) Field of Classification Search
CPC ..... B65D 19/0016
USPC ..... 108/57.25, 53.1, 51.11, 57.12
See application file for complete search history.

(56) References Cited

U.S. PATENT DOCUMENTS 3,648,883 A * 3/1972 Bridenstine ..... B65D 1/34 220/607
3,750,596 A * 8/1973 Box ..... B65D 19/0014 108/53.1
3,750,598 A * 8/1973 Campbell ..... B65D 19/0004 16/86 A
3,926,321 A * 12/1975 Trebilcock ..... B65D 85/62 206/446
4,051,787 A * 10/1977 Nishitani ..... B65D 19/0012 108/55.3
4,397,246 A * 8/1983 Ishida ..... B65D 19/0012 248/346.02
4,580,680 A * 4/1986 Wind ..... B65D 19/0018 108/55.3

(Continued)

FOREIGN PATENT DOCUMENTS

EP 3979788 A2 2/2000
EP 1652784 A1 5/2006

(Continued)

*Primary Examiner* — Jose V Chen

(57) ABSTRACT

A pallet made of plastic, having a pallet deck and pallet runners. The runners extend the length of the pallet and have a substantially rectangular form. The runners and the pallet deck have formations that allow a form-fit engagement of two pallets of the same type that are stacked one above the other. The form-fit engagement creates a stable stack. The formations on the pallet deck are also designed to allow wooden pallets to be stacked on the pallet according to the invention.

9 Claims, 5 Drawing Sheets

(56) References Cited

U.S. PATENT DOCUMENTS 4,700,959 A * 10/1987 Lars ..... B62B 3/00 52/657
5,052,307 A * 10/1991 Morrison ..... B65D 19/38 108/55.3
5,092,252 A * 3/1992 Gillhart ..... B65D 19/0028 108/55.3
6,138,582 A * 10/2000 Fujii ..... B65D 19/0069 108/57.25
6,357,366 B1 * 3/2002 Frankenberg ..... B65D 19/0026 108/57.25
6,386,118 B1 * 5/2002 Bendit ..... B65D 19/0016 108/57.25
6,807,911 B2 * 10/2004 Carson ..... B65D 19/0018 108/901
6,874,428 B2 * 4/2005 Apps ..... B65D 19/0016 108/57.25
7,090,078 B2 * 8/2006 Gits ..... B65D 19/44 206/319
10,029,819 B2 * 7/2018 Storteboom ..... B65D 19/0073
11,279,516 B2 * 3/2022 Valdés ..... B65D 19/0063
2006/0272556 A1 * 12/2006 Apps ..... B65D 19/004 108/53.1
2008/0210140 A1 * 9/2008 Valentinsson ..... B65D 19/0014 108/51.11
2010/0218705 A1 * 9/2010 Mani ..... B65D 19/0073 108/57.17
2012/0325125 A1 * 12/2012 Apps ..... B65D 19/0014 108/51.11
2014/0283713 A1 * 9/2014 Baltz ..... B62B 5/0093 108/51.11
2015/0274359 A1 * 10/2015 Linares ..... B65D 19/0004 108/53.1
2016/0288951 A1 * 10/2016 Rader ..... B65D 19/0016
2016/0368659 A1 * 12/2016 Bastian, II ..... B29C 39/18

FOREIGN PATENT DOCUMENTS

JP H08207932 A 8/1996
JP 2008127045 A 6/2008

* cited by examiner

PALLET WITH STACKING STOPS ON THE PALLET DECK

BACKGROUND INFORMATION

Field of the Invention

The invention relates to the field of pallets. More particularly, the invention relates to plastic pallets.

Discussion of the Prior Art

Large numbers of conventional pallets are known in the industry, most of which are made of wood. These wooden pallets are often particularly inexpensive disposable pallets, but there area also higher quality wooden pallets that are constructed, so as to last through multiple use cycles.

A smaller number of the pallets are made of plastic. Plastic pallets, also known as skids, are preferred particularly in fields where hygiene concerns are high, because the smooth plastic surface does not readily absorb dirt and is particularly easy to clean.

Compared to wooden pallets, plastic pallets slide more easily. This can be problematic when empty plastic pallets are stacked directly one on top of the other. It is known to provide an anti-slip coating or device on plastic pallets, in order to allow such empty pallets to be stacked in a secure manner. The anti-slip effect on a pallet can sometimes be diminished, depending on weather conditions. For example, a layer of frost on a pallet reduces the anti-slip effect.

It is known to provide projecting contours on a pallet, for example, edge strips that project upwards beyond the surface of the pallet deck. In some cases, these strips are placed within the base load area of the pallet deck, and in other cases, are placed outside the base load area, so that the pallet deck maintains a full, standardized pallet load area of, for example, 1200×800 mm, on which the load can be placed. In highly automated environments, such as fulfillment centers and the like, such projecting contours that extend beyond the standardized dimensions of a pallet can create problems with automated materials handling systems.

What is needed, therefore, is a pallet that is stackable with other pallets to form a stack that is stable. What is yet further needed is such a stackable pallet that maintains standardized dimensions.

BRIEF SUMMARY OF THE INVENTION

The invention is a plastic pallet that allows empty pallets according to the invention to be stacked into a stack that has high stability. The invention also allows wooden and plastic pallets to be stacked together. To achieve this, the pallet according to the invention has stacking stops on its pallet deck and voids on its runners that accommodate the stacking stops of another pallet of the same construction. Thus, stacked pallets of the same construction form a positive fit with one another, thereby creating a stable stack.

Some facilities work with both plastic and wooden pallets. For this reason, the pallet according to the invention is constructed to allow a wooden pallet to be reliably stacked on top of the plastic pallet.

The pallet according to the invention is a rectangular pallet, i.e., has two long sides and two short sides. The short sides form the front and rear end faces of the pallet and have the forklift pockets that allow the pallet to be transported by an industrial truck. The bottom of the pallet has three parallel runners or skids that extend the length of the pallet and provide the contact surface of the pallet with the floor. Between the pallet deck and the runners are legs that provide space for the forklift pockets. The pallet deck, i.e., the upper surface of the pallet, has a base load area for receiving a load of goods. Typically, the base load area of the pallet is a standardized dimension and the pallet shown herein is a standard European pallet that has a base load area of 800×1200 mm. It is understood, however, that the present invention is not limited to a pallet having these dimensions.

The pallet according to the invention has runners that differ from the typical runner on a wooden pallet. Wooden runners are rectangular. They are flat boards that have been simply cut to length, i.e., they have square or 90-degree corners. The pallet according to the invention, by contrast, has runners that extend the length of the pallet, but the corner areas of the runners are rounded or have a 45-degree chamfer, in other words, have a contour at the corners that deviates from an exactly rectangular contour, thereby creating an open space in the corner areas. This open space is hereinafter referred to as a void.

Multiple stacking stops are provided on the pallet deck, placed on each of the short sides at locations that are directly above the voids formed at the corners of the runners below the deck. When pallets of the same type are stacked, the stops of a lower pallet are received in the voids on each side of the runner, and this prevents the pallets from shifting in the longitudinal direction, as well as in the lateral direction.

The pallet deck is a substantially rectangular surface, but the corners of the deck are rounded. Thus, the corners of the deck do not provide a surface on which to provide a stop. The three runners with their rounded corners thus provide a total of four voids that are covered by the pallet deck. Thus, up to four stops may be provided near the edges of the short sides of the pallet deck at locations that are aligned with a corresponding void in the runners below the deck—two middle stops, one above a void on each side of the middle runner, and two outer stops, each one above an inner void of the two outer runners. These four stops provide an optimum form fit with a pallet of the same construction stacked above it.

The two outer stops may have a smaller height than the two middle stops. When plastic pallets of the same type are stacked together, the greater height of the two middle stops ensures an optimum form fit and the two outer stops merely serve a supportive role. It is a particular advantage of the pallet according to the invention, however, that a wooden pallet may also be reliably stacked on the pallet. To achieve this, the middle runner of the pallet according to the invention is constructed to be wider than the width of a typical wooden pallet. Because the middle stops are located above the voids on the middle runner, they are spaced wider apart than the wooden pallet runner. Thus, when a wooden pallet is stacked on the pallet according to the invention, the middle stops do not make contact with the runner on the wooden pallet, but rather, those stops project into the spaces between the wooden runners. Instead of resting on all four stops, the wooden pallet rests on the outer stops only.

Depending on the construction of the runners on the pallet according to the invention and/or the wooden pallet, however, it is possible that the wooden pallet rests on all four of the stops. The fact that the two middle stops are greater in height would mean that they act as a tilt axis for the wooden pallet, that is to say, the wooden pallet would be able to tilt to either side of the pallet. In this case, the wooden pallet, due to its inherent elasticity, rests on all four stops and the outer stops prevent the wooden pallet from tilting.

The stops may be constructed as vertically upright buttons or knobs. It is desirable to keep the cross-sectional area of the stops as small as possible, first of all, because they should fit within the voids at the corners of the runner, but also, because these stops are provided within the base load area of the pallet deck and a load of goods that takes up the full base load area may be placed on top of these stops. The cross-sectional area of the stops is kept as small as possible in order to keep the risk of damaging the goods as low as possible. Thus, the dimensions of the stops are such that, even if the stops should make a slight indentation into cardboard packaging, for example, the pressure or deformation exerted on the load of goods is not enough to damage the actual goods.

The stops may have a constant cross-section, i.e., have straight wall in the vertical direction and a flat top. This provides optimum mechanical stability compared to stops that taper sharply towards the upper end. This also reduces the risk that the stops become damaged or deformed, when a load is placed on the stops. Also, the flat top allows a wooden pallet, which has runners without the voids, to be stacked on the pallet, so that the wooden pallet and any additional pallets that are stacked thereon are also resting on the stops.

A suitable height of the stops that extends upward of the pallet deck is between 3 and 10 mm, and preferably between 4 and 6 mm. Initial tests have shown that these dimensions are a good compromise between keeping the stops as flat as possible, yet having sufficient height to create a positive fit with the voids. These dimensions ensure a reliable positive fit, which in turn ensures a secure stack of plastic pallets of the same type, yet are sufficiently low to avoid undesirable damage, both to the stops as well as to the goods placed on the pallet.

An anti-slip coating or material may be applied to some areas of the pallet deck. Anti-slip means are known in the industry, and thus, there is no need to discuss such means in more detail herein. The anti-slip surface increases the stability of the stack with pallets of an identical or a different construction. However, if the anti-slip effect is diminished, due to moisture, ice formation or the like, the stops according to the invention still ensure a stable stack of pallets.

BRIEF DESCRIPTION OF THE DRAWINGS

The present invention is described with reference to the accompanying purely schematic drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
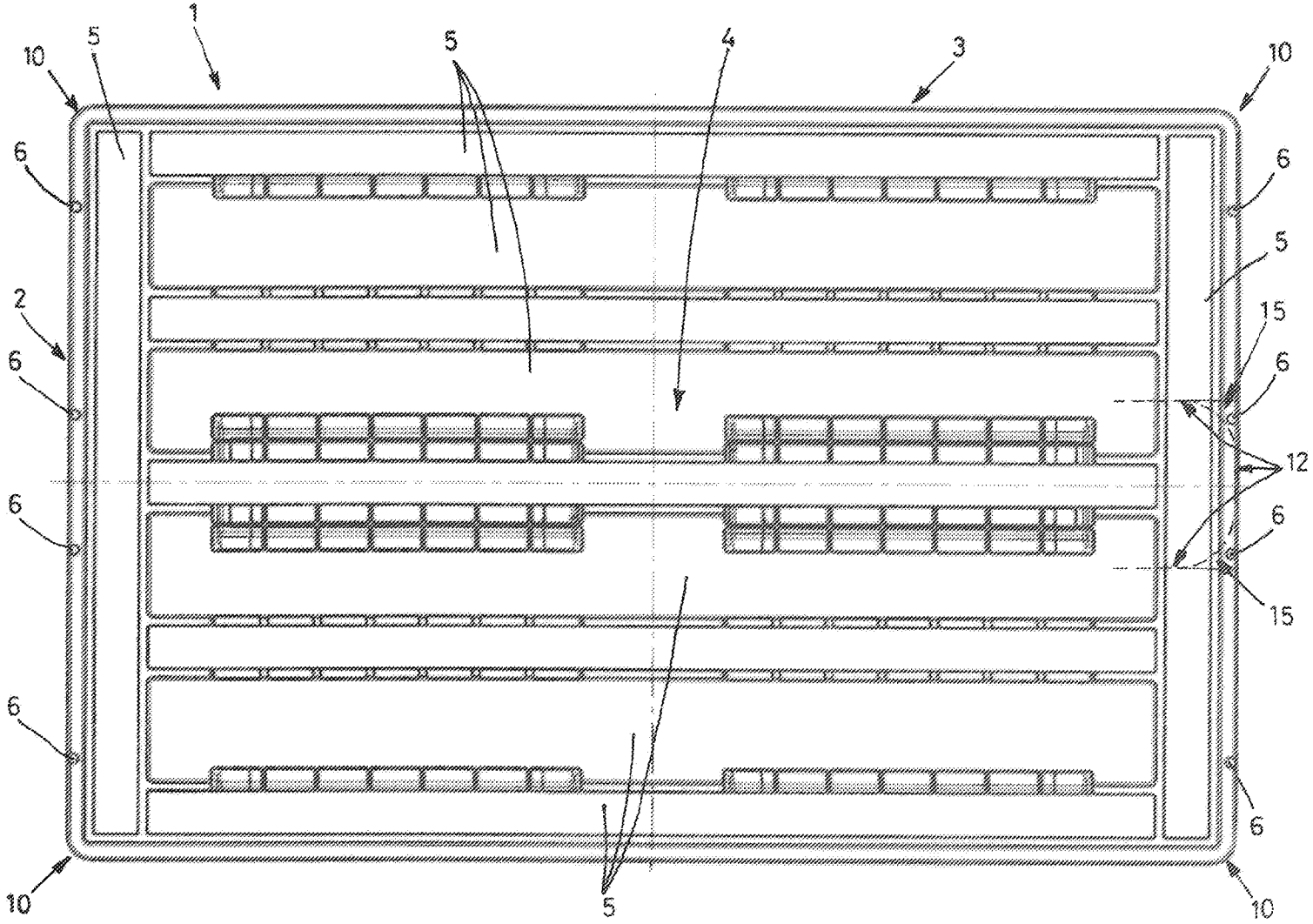
FIG. 1 is a top plane view of a pallet according to the invention.

FIG. 1 is a plane view of a plastic pallet 1 according to the invention, which, purely by way of example, is a Euro pallet having a standardized load area of 800 mm×1200 mm. The pallet 1 is substantially rectangular in shape with two short sides 2 and two long sides 3 and a pallet deck 4. Strips of an anti-slip coating or material 5 are provided on the pallet deck 4. Reinforcing steel profiles (not shown) may be provided under some of these strips, to stiffen the pallet 1 in the lengthwise and crosswise directions.

In the embodiment shown, four stops 6, constructed as cylindrical knobs, are provided near the edges of the short sides 2 of the pallet deck 4—two middle stops 6 and two outer stops 6. Tests have shown that the most suitable heights for the middle stops are between 5 and 6 mm, and preferably 5.5 mm, and for the outer stops between 3.5 and 4.5 mm, and preferably 4 mm. In this embodiment, the middle stops 6 project 5.5 mm above the surface of the pallet deck 4 and the two outer stops 6 project 4 mm above the pallet deck 4.

Figure 2:
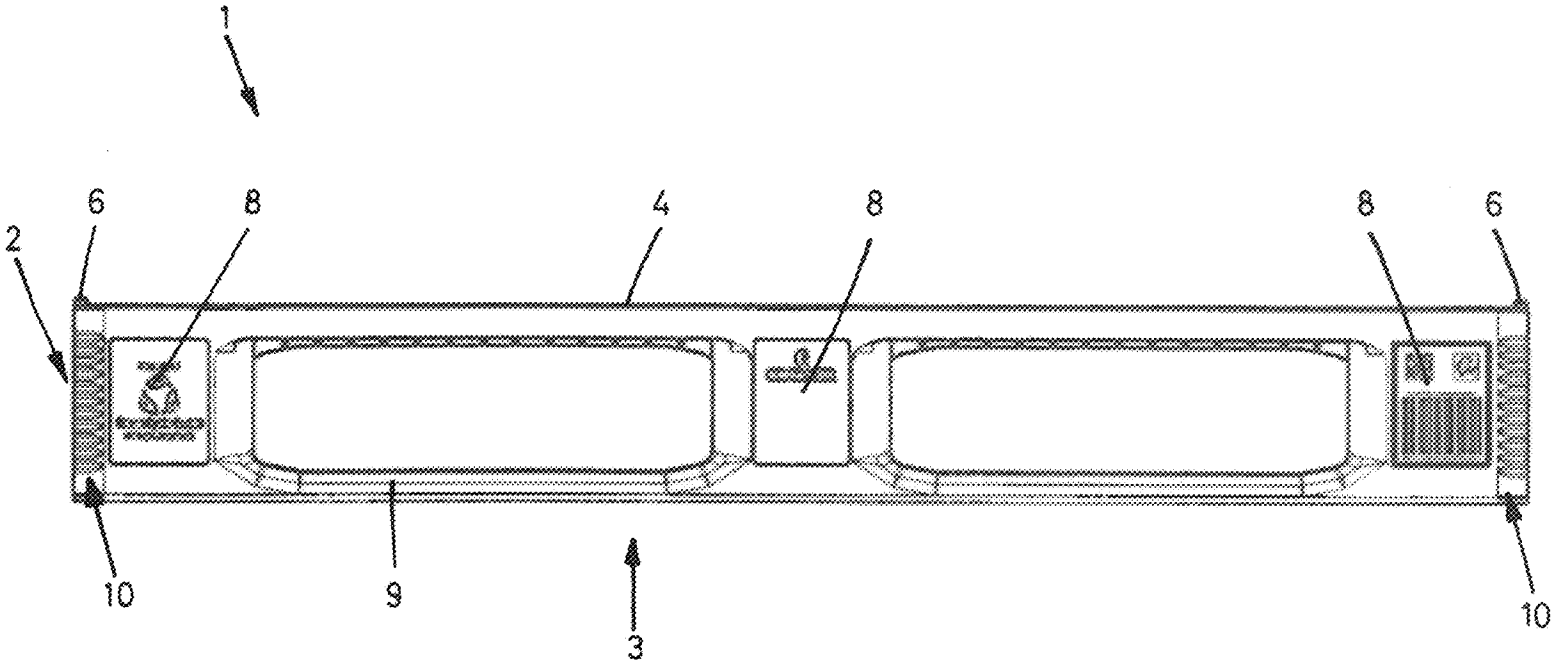
FIG. 2 is a side plane view of a long side of the pallet.

FIG. 2 is a side plane of the long side 3 of the pallet 1, showing two openings defined by the pallet deck 4 at the top, legs 8 at the sides, and runners 9 at the bottom, whereby the runners 9 extend the entire length of the pallet 1.

Figure 3:
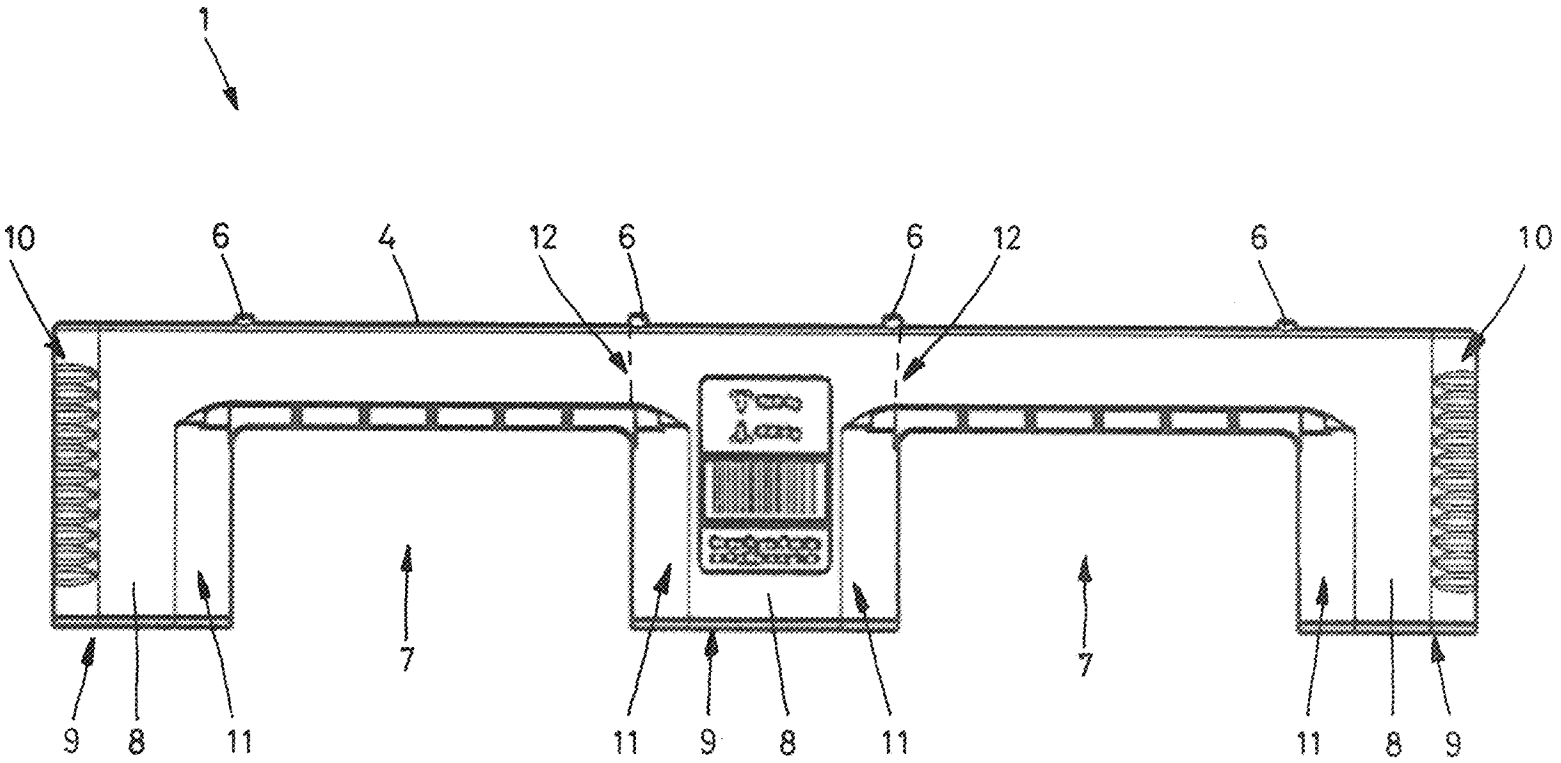
FIG. 3 is a side plane view of the short side of the pallet, showing forklift openings and the placement of stops above void areas of the runners.

FIG. 3 is a plane view of the short side 2 of the pallet 1. Two forklift pockets 7 are created between the three runners 9 into which an industrial truck drives a fork. In a suitable construction for plastic material, the four outer corners of the pallet 1 and the four outer legs 8 at those outer corners have rounded corner areas 10, with a first bending radius. The remaining legs 8 also have rounded areas 11, but the with a second bending radius that is greater than the first bending radius.

Figure 4:
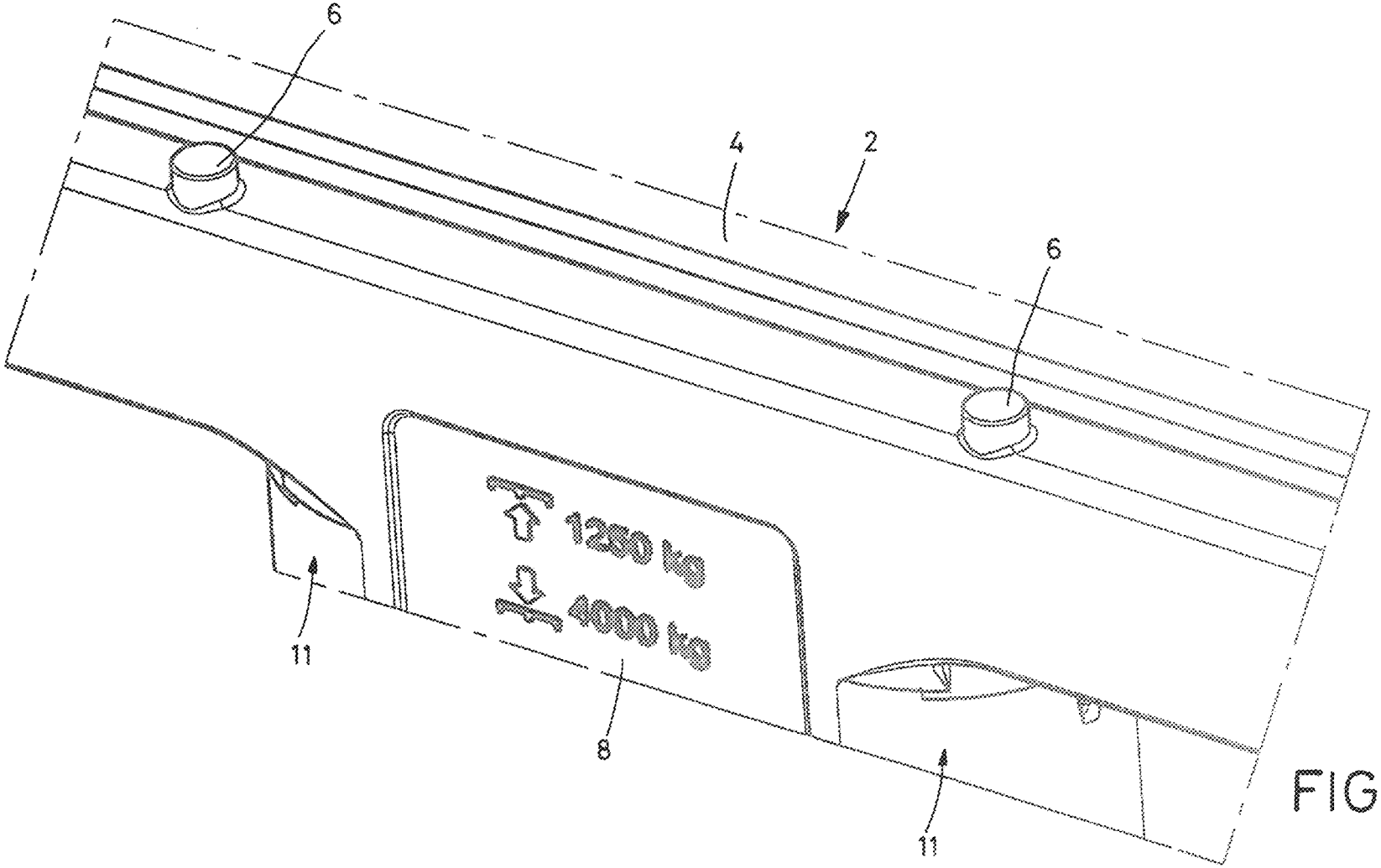
FIG. 4 is a perspective view from above of two middle stops of the pallet.

FIG. 4 shows a partial perspective view from above of a short side 2 and the middle leg 8, as well as the two middle stops 6, which are provided completely within the standardized dimensions of the pallet of 800×1,200 mm of the Euro pallet, that is to say, do not extend beyond the dimensions of the pallet deck 4.

Figure 5:
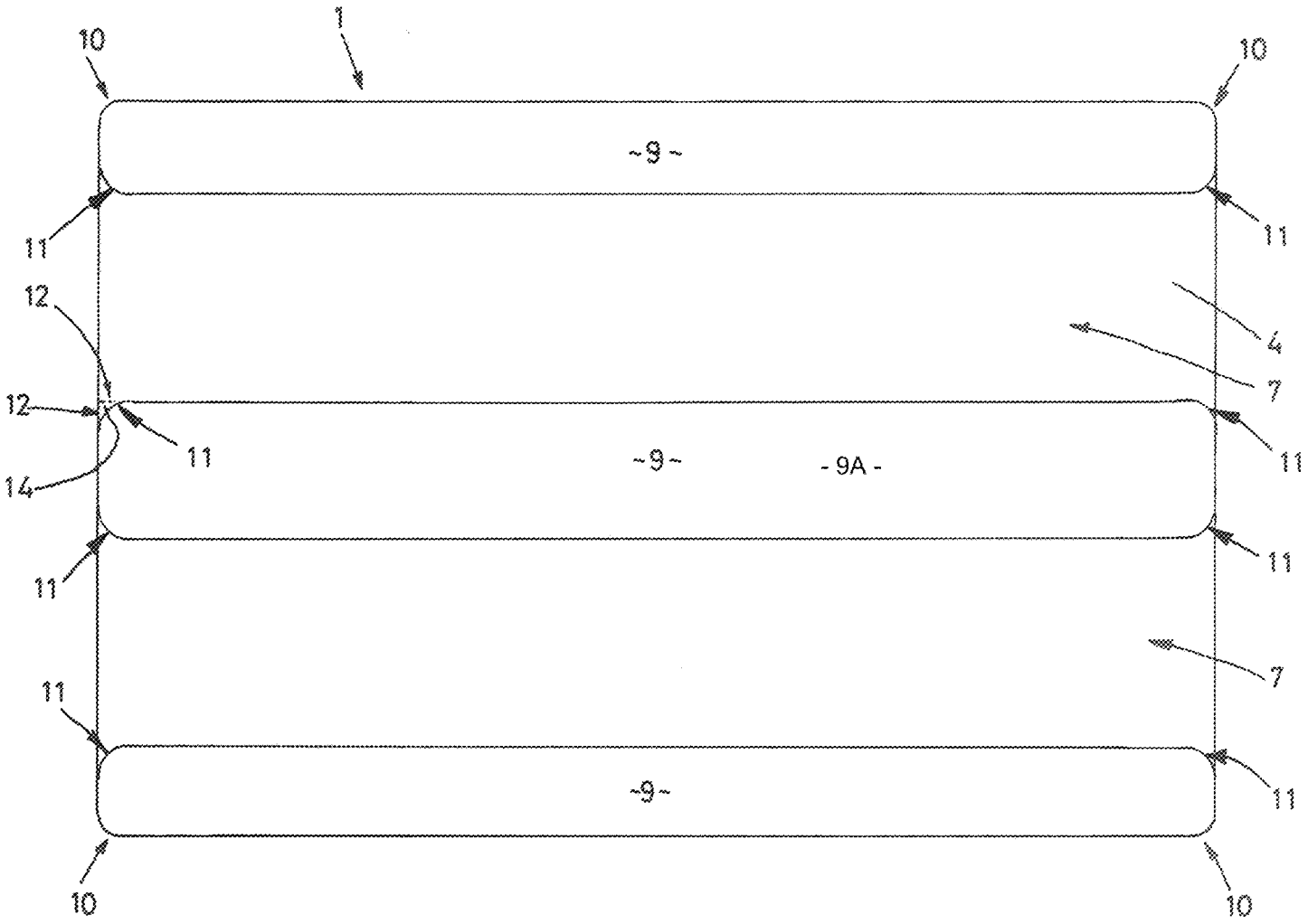
FIG. 5 is a bottom plane view of the pallet, showing a middle runner that is wider than the outer runners and also showing the voids at the rounded corners.

FIG. 5 is a bottom plane view, showing the three runners 9 that run along the bottom of the pallet 1. The contact surface of each runner 9 is shown as being substantially rectangular, with rounded outer corner areas 10 and rounded inner corner areas 11, whereby in this embodiment the first bending radius of the outer corner areas 10 is smaller than the second bending radius of the inner corner areas 11. The dashed lines 12 reference an approximately triangular open space, i.e., a void 14 at the inner corner areas 11. This void 14 does not exist on the runners of a wooden pallet, which are typically cut with a straight cut and, thus, have square corners.

Referring now to FIG. 1, the dashed lines 12 indicate the contour of the end of the middle runner 9 which runs beneath the pallet deck 4 and is normally not visible from above the pallet 1. These dashed lines 12 show void regions 15 that correspond to the voids 14 that are available on runners on a pallet of identical construction. When two pallets 1 are stacked together, the two middle stops 6 that are provided within these void regions 15 on the lower pallet 1 engage in a form-fit manner with the voids 14 of the upper pallet 1, to achieve the desired stability of stacked pallets 1.

In the embodiment shown, the two outer stops 6 allow a wooden pallet to be reliably stacked on the pallet 1. As previously mentioned, the runners on wooden pallets are precisely rectangular, i.e., without voids at the corners. As can be seen in FIG. 5, a middle runner 9A is wider than the two outer runners 9. This middle runner 9A is wider than the middle runner on a typical wooden pallet, which means that the middle stops 6 in this embodiment of pallet 1 are spaced apart a distance that is greater than the width of the middle runner on the wooden pallet. When a wooden pallet is stacked on the pallet 1, these middle stops 6 do not make contact with the wooden pallet, but rather, extend into the spaces between the wooden pallet runners. Hence, the wooden pallet rests only on the two outer stops 6.

In another embodiment (not shown), the middle runner 9 may have a width dimension similar to that of the middle runner on the typical wooden pallet. In this case, the wooden pallet rests on all four stops 6. Because the middle stops 6 have a greater height than the outer stops 6, there would be a tendency for the wooden pallet to tile to one side or the other. The outer stops, which are slightly lower in height, prevent the wooden pallet from tilting.

It is understood that the embodiments described herein are merely illustrative of the present invention. Variations in the construction of the pallet with stacking stops may be contemplated by one skilled in the art without limiting the intended scope of the invention herein disclosed and as defined by the following claims.

What is claimed is:

1. A pallet made of plastic for supporting and transporting a load, the pallet comprising:

an upper surface that is a pallet deck;

a lower surface that is formed by a plurality of runners; and a plurality of stops that are provided on the pallet deck;

wherein each runner is an elongated, substantially rectangular contact surface having four runner corners;

wherein each runner corner has a contour that provides a runner void;

wherein the pallet deck has a plurality of void regions, each of which is vertically aligned with a respective runner void;

wherein the stops are constructed as knobs that extend upward from the pallet deck; and wherein one or more of the stops is provided in a respective one or more of the void regions.

2. The pallet of claim 1, wherein the stops have a constant cross-section.

3. The pallet of claim 1, wherein the stops have a height that projects above the pallet deck within a range of 3 to 10 mm.

4. The pallet of claim 3, wherein the stops have a height that projects above the pallet deck within a range of 4 to 6 mm.

5. The pallet of claim 1, wherein the plurality of runners includes a middle runner;

wherein the plurality of stops includes two middle stops and two outer stops that are provided along at least one edge of the pallet deck; and wherein the two middle stops are provided in the void regions that are aligned with the runner voids of the middle runner.

6. The pallet of claim 5, wherein the two middle stops have a first height and the two outer stops have a second height that is lower than the first height.

7. The pallet of claim 6, wherein the first height is within a range of 5 to 6 mm and the second height is within a range of 3.5 to 4.5 mm.

8. The pallet of claim 5, wherein two outer runners of the plurality of runners have a first width dimension and the middle runner has a second width dimension that is wider than the first width dimension; and wherein the second width dimension is sufficiently wide that the two middle stops are spaced apart a distance that is greater than a width of a runner on a wooden pallet.

9. The pallet of claim 1, wherein at least some areas of the pallet deck have an anti-slip surface.

* * * * *